United States Patent [19]

Lowe

[11] Patent Number: 4,921,228

[45] Date of Patent: May 1, 1990

[54] BOX SPRING UNIT WITH INTERLOCKING SPRING AND GRID ASSEMBLY

[75] Inventor: Mark A. Lowe, Flemingsburg, Ky.

[73] Assignee: Hoover Group, Inc., Alpharetta

[21] Appl. No.: 267,378

[22] Filed: Nov. 4, 1988

[51] Int. Cl.[5] ..... A47C 23/02

[52] U.S. Cl. ..... 267/103; 5/247; 5/267; 5/268; 267/106

[58] Field of Search ..... 267/103, 104, 105, 106, 267/107, 108, 109, 111, 144; 5/247, 255, 260, 264 B, 267, 273, 268, 270, 274, 275, 276, 476

[56] References Cited

U.S. PATENT DOCUMENTS

| | | | |
|---|---|---|---|
| 790,614 | 5/1905 | Bridgewater | 5/277 |
| 4,101,993 | 7/1982 | Yates et al. | 5/267 |
| 4,339,834 | 7/1982 | Mizelle | 5/247 |
| 4,559,654 | 12/1985 | Mizelle | 5/247 |
| 4,577,841 | 3/1986 | Hagemeister | 267/103 |
| 4,778,157 | 10/1988 | Thomas | 267/106 X |
| 4,779,293 | 10/1988 | Dabney et al. | 5/268 |
| 4,805,883 | 2/1989 | Kitchen | 267/103 |

FOREIGN PATENT DOCUMENTS

| | | | |
|---|---|---|---|
| 1963397 | 8/1978 | Fed. Rep. of Germany | 267/103 |

*Primary Examiner*—Andres Kashnikow
*Assistant Examiner*—Matthew C. Graham
*Attorney, Agent, or Firm*—Harness, Dickey & Pierce

[57] ABSTRACT

A box spring assembly comprises a horizontal rectangular frame, a generally horizontal mattress support deck disposed a predetermined distance above the frame, and a plurality of deck support springs arranged between the deck and the frame to yieldably support the deck. The deck includes a plurality of long and cross deck wires each having notches. The long and cross deck wires are oriented in a criss-cross fashion engaging each other at the notches, and a plurality of deck support springs having notched deck attaching portions engaged with the notched intersections of the wire members. At least one of the deck attaching portions includes a pair of end straight wire sections arranged in a side-by-side relation with a spaced pair of the deck wire members and arranged in a supporting relation with spaced portion of another one of the deck wire members that intersects the spaced pair interlocking the deck wire members and the straight wire section together.

13 Claims, 4 Drawing Sheets

BOX SPRING UNIT WITH INTERLOCKING SPRING AND GRID ASSEMBLY

BACKGROUND AND SUMMARY OF THE INVENTION

This invention relates generally to mattress foundation structures and more particularly to a box spring assembly of the type which utilizes non-coil springs. Box spring assemblies of this general type have been known since 1964, the first of such spring assemblies being disclosed in U.S. Pat. No. 3,286,281. Subsequently issued patents disclosing the same general type of box spring assembly are: U.S. Pat. Nos. 3,487,480; 3,506,987; 3,574,240; 3,574,241; 3,665,529; 3,680,157; 3,755,833; 3,824,639; 3,852,838; 4,060,862; 4,120,058; 4,131,961; 4,195,376; 4,218,790; 4,238,861; 4,251,892; 4,253,208; 4,339,834; 4,398,705, and 4,470,584.

Box spring assemblies of the general type shown in the above list of patents, all of which are owned by the assignee of this application, are advantageous with respect to the conventional box spring assemblies using coil springs because they provide a desired stiffer foundation for the mattress and contain a reduced amount of wire. These box spring assemblies are also advantageous from the standpoint of prolonged service life, ease of assembly and cost of manufacture. Additional box spring assemblies of this general type are shown in U.S. Pat. Nos. 3,546,723; 3,596,299; 3,722,013; 3,825,960; 3,833,948; 3,835,485; 3,869,740; 3,990,121; and 4,000,531.

Some current box spring assemblies typically have a wire grid assembly which is supported by an array of springs attached to a supporting frame. One approach of reducing the cost of the box spring assembly is to minimize the gauge of the wires making up the grid assembly. Grid assembly wire diameter, however, is dependent upon the characteristics of the spring units on which the grid is supported. Some spring unit types do not distribute their loads evenly over the grid assembly but instead exert undesirable localized or point loads which tend to permanently deform portions of the grid assembly when it is subjected to bedding loads.

A spring module which reduces the localized loading on the grid assembly formed from wire having a reduced diameter is shown and described in U.S. Pat. No. 4,739,977, owned by the assignee of the present invention. This patent discloses an improved spring for box spring assembly in which the springs provide self limited deflection to prevent them from taking on a permanent set after being overloaded and the top portion of the spring spreads out forces over a large area on the grid to reduce point loading. This allows use of grid wire of a reduced diameter or higher gauge.

Another aspect which effects the cost of production of spring unit of a box spring assembly is the number of individual component parts. For example, the box spring assembly as disclosed by the patent above includes a frame, a wire grid, various deck support spring units, and a plurality of clips which are used to secure the springs to the wire grid. Placement of the wire grid on the springs requires the separate steps of placing these clips and of crimping these clips around the wires of the spring unit and the wire grid members. The separate application of these clips adds steps which affect the overall cost of construction of the box spring assembly.

U.S. Pat. No. 4,339,834 discloses a support spring module of the limited deflection type which is designed to interlock with the intersecting wire deck members of a box spring assembly without the use of clips. Each spring interlocks with a single intersection of criss-crossed wire deck members. Therefore, a spring is associated with each intersection in the wire grid.

The spring interlocking with the crossed wires at the intersection creates a stack of wires at the intersection three wires diameters high creating an undesirably high hump at each intersection rather than maintaining a flat deck surface. It is desirable to minimize the stacking of wires at the intersection to maintain a generally flat wire deck surface.

U.S. Pat. No. 4,398,705 discloses a support spring module identical to that disclosed in U.S. Pat. No. 4,339,834 used with a welded wire grid. Once again, this assembly has the disadvantage that each intersection of wire gird members requires a single support spring interlocked with the intersecting grid wire members at the intersection.

It is therefore an object of the present invention to provide a box spring assembly which requires no fasteners to lock the deck support to the deck wire grid.

It is another object of the present invention to provide a box spring assembly wherein the installation of each deck support spring locks the intersecting grid wires forming a pair of spaced intersections in place with respect to each other and the spring.

It is another object of the present invention to provide an interlocked spring and wire grid assembly that prevents shifting of the wire grid members and springs.

It is another object of the present invention to provide a box spring assembly wherein the thickness at the intersections between the deck support springs and the grid members are only two wire diameters to maintain a flat support deck.

It is a further object of the present invention to provide a box spring assembly wherein the force holding the long wires of the wire grid in place is provided by the deck support springs.

A box spring assembly according to the present invention includes a generally rectangular frame, a mattress support deck disposed a predetermined distance above the frame, and a plurality of deck support springs arranged between the deck and the frame so as to yieldably support the deck on the frame. The deck is made up of a plurality of criss-crossed wire deck members having spaced notches. These notches are engaged at or adjacent the intersection of the wire members and thus coact to maintain the wire deck members in the criss-crossed configuration forming a wire grid. The ends of the criss-crossed deck wire members are attached to a border wire which forms the perimeter of the mattress support deck.

The deck support springs arranged between the deck and frame to yieldably support the deck on the frame each has a vertical yieldable portion mounted to the frame at one end, and terminating at the other end in a deck attaching portion. The deck attaching portion includes a pair of straight end wire sections arranged in a side-by-side parallel relation. The end straight wire sections are interlocked with a spaced pair of intersections of the deck wire members to lock the deck wire members and the spring together at the notches in the deck support springs adjacent the notched intersections of the deck wire members.

Further benefits and advantages of the present invention will become apparent to those skilled in the art to which this invention relates from the subsequent description of the preferred embodiment and the appended claims taken in conjunction with the accompanying drawings.

BRIEF DESCRIPTION OF THE PREFERRED EMBODIMENTS

DETAILED DESCRIPTION OF THE PREFERRED EMBODIMENTS

Figure 1:
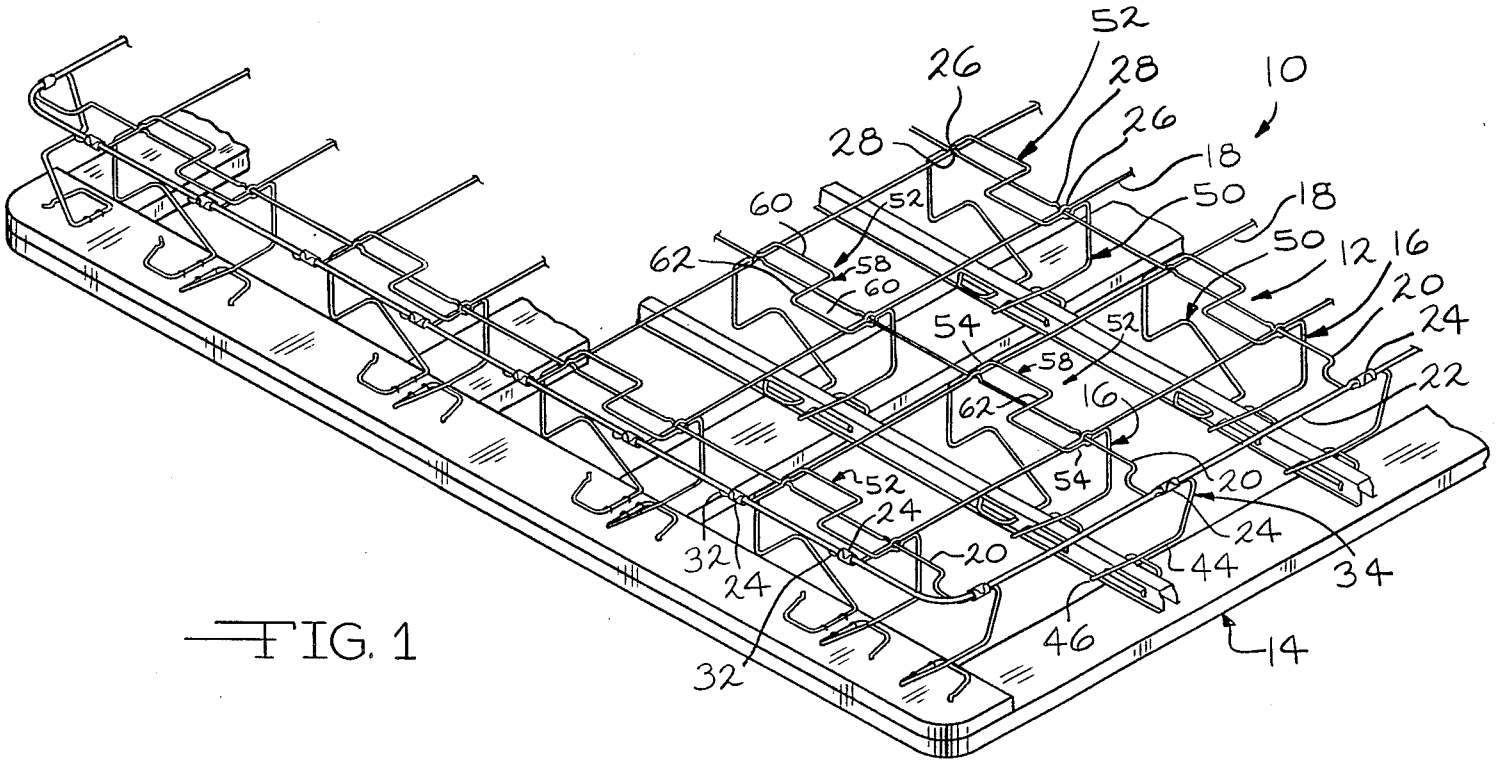
FIG. 1 is a fragmentary perspective view of a box spring assembly according to the present invention.

A box spring assembly in accordance with this invention is shown in FIG. 1 and is generally designated by reference number 10. Box spring assembly 10 includes a mattress support deck 12 disposed at a predetermined distance above a generally rectangular frame 14 by a plurality of deck support springs 16. The interlocking placement of deck support springs 16 on the wire grid or mattress support deck 12 interlocks the wire deck and springs together as will be discussed below.

Rectangular frame 14 consists of a pair of side rails 15, a pair of end rails 17, one of which is shown in FIG. 1, and a plurality of cross rails 19.

Mattress support deck 12 consists of a plurality of long deck wires 18 which run parallel to the longer dimension of the rectangular box spring assembly 10, and a plurality of cross wire springs 20 which are arranged in a generally criss-crossed fashion perpendicular to the long wires 18. The long wires 18 and cross wire springs 20 are attached to a border wire 22 via clips 24 which bind the long wires 18 and cross wire springs 20 to the border wire 22 forming the wire grid or mattress support deck 12.

Figure 2:
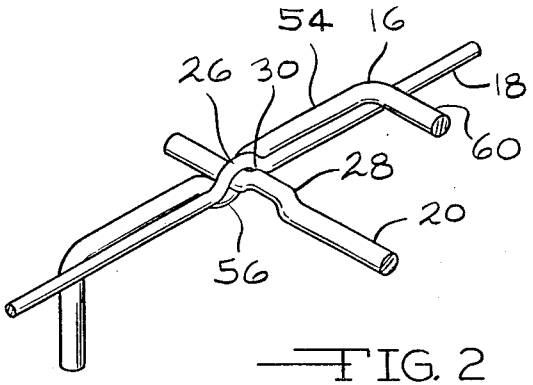
FIG. 2 is an enlarged fragmentary perspective view of one intersection of interlocked deck wires with one end of the deck attaching portion of a spring.
Figure 3:
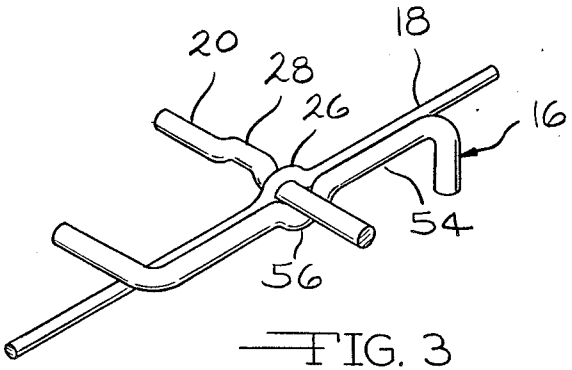
FIG. 3 is an enlarged fragmentary perspective view of the other end of the deck attaching portion of the spring shown in FIG. 2.

The long wires 18 and cross wire springs 20 each have a plurality of spaced upwardly arched notches 26 and 28 respectively. These notches are located at the intersections between the long wires 18 and cross wire springs 20. As shown in FIGS. 1, 2 and 3, each of the notches 26 in the long wires 18 saddles the cross wire spring 20 adjacent the upwardly arched notch 28. Therefore the outside shoulder 30 on the upwardly arched notch 28 in the cross wire spring 20 coacts with the upwardly arched notch 26 in the long wire 18 to preclude side movement of the long wire 18 in a direction toward the arched notch 28 in the cross wire spring 20.

Thus, coaction between the notches in the long wire springs 18 and the cross wire springs 20 precludes side motion of the long wires 18 in one direction. In addition, the cross wire spring 20 being engaged in the notch 26 in the long wire 18 prevents sideways movement of the cross wire spring 20 in either direction. Finally, sideways movement of the long wires 18 in a direction away from the upwardly arched notches 28 in the cross wire springs 20 is prevented by coaction of the long wires 18 with the springs 16 as more fully described below.

Each long wire 18 has a pair of terminal ends 32 bent parallel to and positioned adjacent the border wire 22. These ends are clipped to the border wire 22 via clips 24 to maintain the horizontal spacing and support of the long wires 18 in the wire grid or mattress support deck 12.

Figure 4:
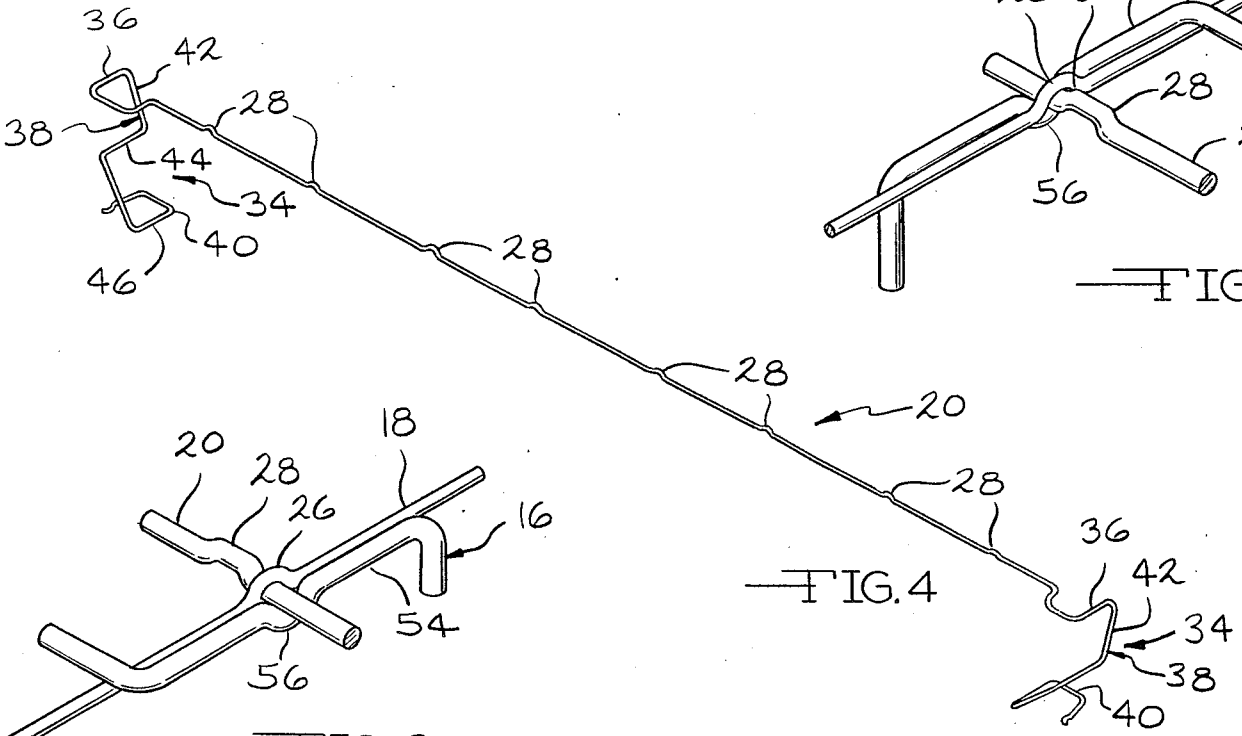
FIG. 4 is a perspective view of one of the cross wire springs isolated from the box spring assembly shown in FIG. 1.

The cross wire springs 20 each have a spring portion 34 at each end. The spring portion 34 comprises a border wire attaching portion 36 which is bent parallel to the border wire 22 and is attached thereto via clips 24 and a vertically yieldable portion 38 which extends downwardly from the border wire attaching portion 36 and terminates in a generally U-shaped foot portion 40. The foot portions 40 are secured to cross rails 19 adjacent side rails 15. The vertically yieldable portion 38 includes a downwardly extending upright column 42 extending downward from the border wire attaching portion 36, an upper torsion bar 44 and a lower torsion bar 46. The torsion bars 44 and 46 are connected together by a connecting bar 48. The upper and lower torsion bars 44 and 46 are generally horizontal in orientation as shown in FIGS. 1 and 4.

Each of the deck support springs 16 interlocked with the criss-crossed long and cross wire members 18 and 20 of the mattress support deck 12 includes a pair of vertically yieldable portions 50 mounted at their lower ends on the frame 14 and joining at their upper ends in a deck attaching portion 52. The deck attaching portion 52 has a pair of end straight wire sections 54 arranged in a side-by-side relation with a spaced pair of long wires 18. The deck attaching portion 52 is also arranged in a supporting relation with spaced portions of one of the cross wire springs 20 intersecting the spaced pair of long wires 18. Each of the end straight wire sections 54 has a downwardly arched notch 56 centrally located and engaged with the cross wire 20 adjacent the upwardly arched notch 28 in the cross wire 20 and adjacent the notch 26 in the long wire 18 thus interlocking the deck wire members 18 and 20 and the end straight wire section 54 together.

The deck attaching portion 52 further includes an intermediate connecting portion 58 comprising two bearing members 60 extending from one end straight wire section 54 perpendicularly toward the other end straight wire section 54 and over long wires 18. Bearing members 60 are connected together by a connecting section 62 oriented parallel to the pair of end straight wire sections 54 and positioned between them. This connecting section 62 passes over intersecting cross wire spring 20 holding cross wire spring 20 into the notches 56.

As can be clearly seen in FIGS. 1, 2 and 3, the cross wire spring 20 notches 28 are spaced so that each pair of long wires 18 either has a pair of spaced notches 29 in the cross wire spring 20 interior to the spaced pair of long wires 18 or outside the spaced pair of long wires 18. Thus a main spring 16 sandwiching a pair of spaced long wires 18 prevents any outward movement of the long wires 18 and the notches 28 in the intersecting cross wire spring 20 prevent inward movement of the long wires 18 toward each other. Finally, the combination of the downwardly arched notch 56 in each of the end straight sections 54 of the deck attaching portion 52 of the spring 16 and the upwardly arched notch 26 in each long wire saddling the intersecting cross wire spring 20 prevents the cross wire spring 20 from any sideways motion.

When the deck support spring is attached at the lower end to the frame, a downward bias force is applied by the main spring bearing members 60 to the long wires 18 to maintain the notches 26 in the long wires 18 firmly engaged with the cross wire springs 20 and adjacent the upwardly arched notches 28 in the cross wire springs 20 thereby firmly interlocking the deck wire members and the spring together. Consequently, a downward force exerted on the cross wire springs 20 transfers a downward force to the spring 16 which in turn transfers a portion of the downward force to the long wires 18 to further firmly lock the wires together during bed loading.

Figure 6:
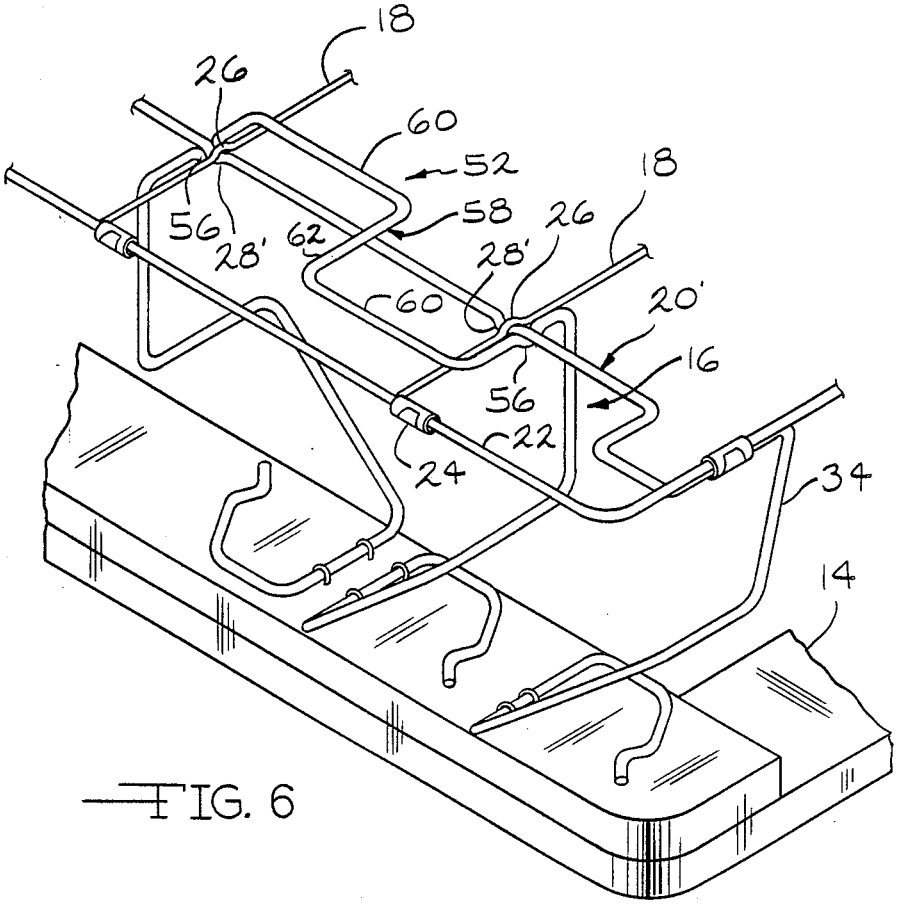
FIG. 6 is a fragmentary perspective view of an alternative preferred embodiment of the present invention.

An alternative embodiment of the present invention is illustrated in FIG. 6. This embodiment differs from the embodiment illustrated in FIGS. 1 through 4 mainly in that the notches 28' in the cross wire spring 20' are downwardly directed and slightly differently spaced. In this embodiment the notches 28' in the cross wire spring 20' are saddled by the notches 26 in the spaced pair of long wire sandwiched between the end straight sections 54 of the deck attaching portion 52 of the spring 16.

The long wires 18 are held secure by the saddled engagement of the long wire notches 26 in the notches 28' in the cross wire springs 20' and the bias force exerted on them by the bearing sections 60 of the spring 16. The wire members are locked in all directions by the notches 56 in the spring. Thus in either embodiment, the notches 56 in the end straight wire sections 54 of the springs 16 engage the cross wire springs 20 or 20' adjacent the notches 28 or 28' of the notched long and cross wires.

The notches 56 in the spring 16 are centered so as to position the cross wire spring 20 or 20' centrally on the spring 16 so that the spring 16 always deflects evenly. Thus downward loading on the cross wire spring 20' actuates the support system. As the cross wire spring 20 or 20' is deflected under load, the cross wire spring 20 or 20' applies a downward force to the main spring 16 at the notches 56. This force is transmitted to the long wires 18 at the point where the bearing portions 60 pass over the long wires 18. Thus, as the spring 16 is deflected, the spring 16 pulls the long wires 18 down also so that the mattress support deck 12 and springs 16 operate as an integral unit.

The deck support springs 16 thus each support a pair of intersections of long wires 18 with a cross wire spring 20. Each intersection is yieldably supported by one of the vertically yieldable portions 50 of spring module 16. This reduces by approximately one-half the number of spring modules 16 required in the total box spring assembly. Accordingly, cost, assembly time and weight are advantageously reduced.

Figure 5:
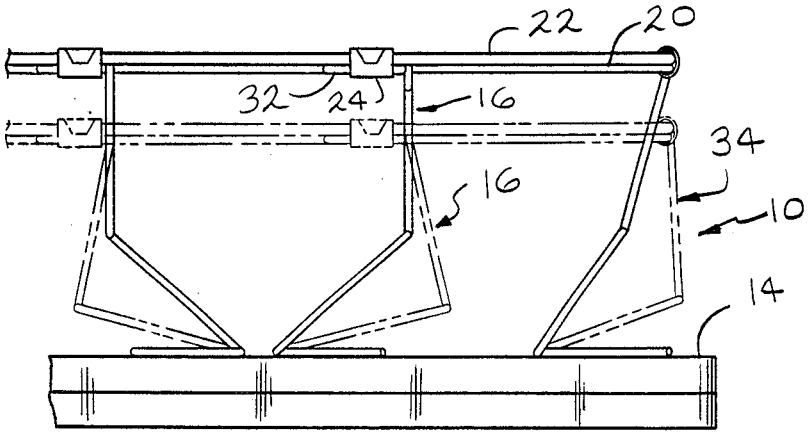
FIG. 5 is a partial side view of the corner of the box spring assembly shown in FIG. 1.

The side view of the box spring assembly 10 shown in FIG. 1 is shown in FIG. 5 illustrating the deflection of the springs 16 under load. FIG. 5 also applies to the alternative embodiment of FIG. 6. The upright columns move generally downward and outward as the upper and lower torsion bars are twisted. Deflection is limited by the upright columns engaging the frame rails at full deflection. During deflection, the wire members and the spring are firmly interlocked with one another as described above.

Figure 7:
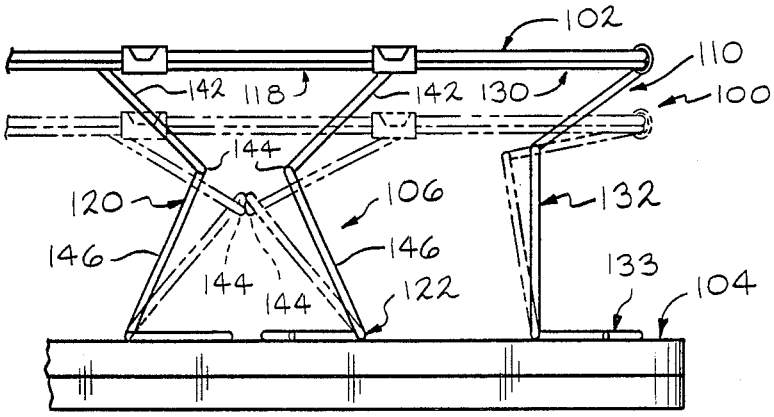
FIG. 7 is a partial side view of one corner of an alternative preferred embodiment of the box spring unit according to the present invention.
Figure 8:
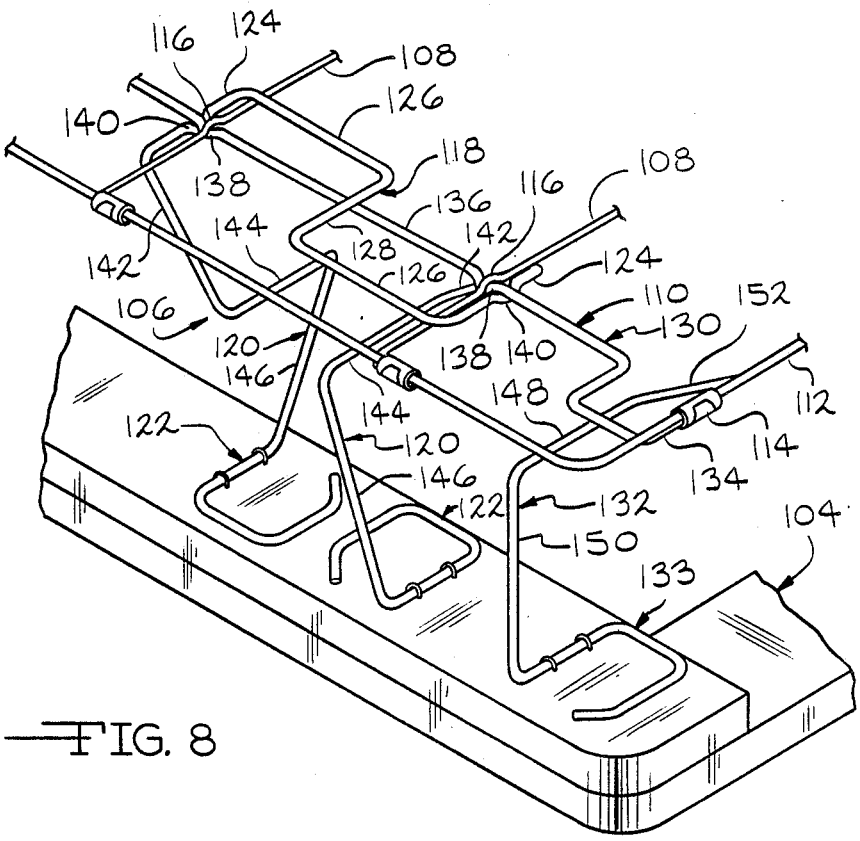
FIG. 8 is a fragmentary perspective view of the alternative box spring unit shown in FIG. 7.

An alternative embodiment of the present invention is shown in FIGS. 7 and 8. In this embodiment, the interlocking arrangement of notches may be as described above and shown in FIGS. 1 through 3, and 6. The alternative embodiment shown in FIGS. 7 and 8 illustrates a different arrangement of vertically yieldable portions of the deck support springs and the cross wire springs.

The box spring assembly 100 shown in FIGS. 7 and 8 includes a mattress support deck 102 disposed at a predetermined distance above a generally rectangular frame 104 by a plurality of deck support spring modules 106. The interlocking placement of deck support spring module 106 on the mattress support deck 102 interlocks the wire deck and springs together in an identical fashion as described above for the other embodiments of this invention.

Mattress support deck 102 consists of a plurality of long deck wires 108 which run parallel to the longer dimension of the rectangular box spring assembly 100, and a plurality of cross wire springs 110 which are arranged in a generally criss-crossed fashion perpendicular to long wires 108. The long wires 108 and the cross wire springs 110 are attached to a border wire 112 via clips 114 which bind the long wires 108 and the cross wire springs 110 to the border wire 112 forming the wire grid or mattress support deck 102. The long wires 108 have a plurality of spaced upwardly arched notches 116 as in the previously described embodiments.

Each spring module 106 comprises a generally planar deck attaching portion 118, a pair of vertically yieldable portions 120, and a foot portion 122 at the lower end of each vertically yieldable portion 120 which is secured to frame 104. The deck attaching portion 118 includes a spaced pair of parallel end straight sections 124. One end of each section 124 is connected to a bearing section 126 extending perpendicular to the end straight sections 124. A connecting section 128 lying parallel to and between end straight sections 124 connects the bearing sections 126 together to form deck attaching portion 118.

Each cross wire spring 110 has an elongated deck attaching portion 130, a pair of vertically yieldable portions 132 extending downward from deck attaching portion 130, and a foot portion 133 at the lower end of each yieldable portion 132. Deck attaching portion 130 has a pair of spaced end straight sections 134 which are clipped via clips 114 to border wire 112 on opposite sides of deck 102 and a connecting section 136 connecting the end straight sections 134 together. Each connecting section 136 of each cross wire spring 110 spans deck 102 crosswise of long wires 108.

The connecting section 136 of each of the cross wire springs 110 may have a plurality of spaced upwardly arched notches as in the embodiment shown in FIGS. 1 through 3. Alternatively, as shown in FIG. 8, the connecting section 136 of each cross wire spring 110 may have a plurality of downwardly arched notches 138 so that the notches 138 in the cross wire springs 110 are saddled by the crossing notches 116 in the spaced pair of long wires 108 sandwiched between the end straight sections 124 of each of the deck attaching portions 118 of the spring modules 106.

The long wires 108 are held secure by the saddled engagement of the long wire notches 116 and the notches 138 in connecting section 136 of the cross wire springs 110 and the bias force exerted on the bearing sections 126 of the deck attaching portion 118. Each of the wire members are further locked in all directions by a midspaced notch 140 in each of the end straight sections 124 in which the connecting section 136 of the cross wire spring 110 resides.

As in the previously described embodiments, when the foot portions 122 of deck support spring 106 are attached to the frame 104, a downward bias force is applied by the main spring bearing members 126 to the long wires 108 to maintain the notches 116 in the long wires 108 firmly engaged with the cross wire springs 110 thereby firmly interlocking the deck wire members and the springs together. Consequently, a bedding load exerted on the cross wire springs 110 exerts a downward force on the spring module 106 which in turn transfers a portion of the bedding load to the long wires 108 to further firmly lock the wires together during bed loading.

The embodiment of the present invention shown in FIGS. 7 and 8 differs from the previously discussed embodiments principally in that the vertically yieldable portion 132 of each of the cross wire springs 110 and the vertically yieldable portions 120 of each spring module 106 are of a limited deflection type as will be subsequently described.

Extending downward from one end of each end straight portion 124 of deck attaching portion 118 is a yieldable portion 120 comprising an upper connecting section 142 which connects to a horizontally oriented torsion bar 144 which is in turn connected to one end of a generally upright lower connecting section 146. The other end of lower connecting section 146 is connected to foot portion 122 which is designed for mounting the spring module 106 to the frame 104. The two generally upright lower connecting sections 146 of spring module 106 are inclined toward each other in the unloaded condition as illustrated by the solid lines in FIG. 7, so that when a bedding load compresses the vertically yieldable portion 120, the torsion bars 144 at the upper ends of lower connecting sections 146 move toward each other and twist in opposite directions. The torsion bars 144 contact each other at full deflection in a cross buck fashion as illustrated in the dashed position shown in FIG. 7. The engagement of torsion bars 144 at full deflection limits the deflection of the vertically yieldable portions 120 so that it becomes a triangular fixed support for the mattress support deck 102.

As in spring module 106, the yieldable portion 132 at each end of the deck attaching portion 130 of cross wire spring 110 includes a middle torsion bar 148 which is horizontally oriented, and a pair of lower and upper connection sections 150 and 152 respectively. Lower connecting section 150 connects one end of the torsion bar 148 to the foot portion 133. The connecting section 150 is generally vertical in the undeflected position as shown in FIG. 7. The connecting section 152 integrally connects the other end of the torsion bar 148 to the deck attaching portion 130 of cross wire spring 110.

As a bedding load is applied to the mattress support deck 102, the torsion bar 148 is placed in torsion and the deck attaching portion 130 moves in a downwardly direction as part of the deck 102 until the portion 130 engages the torsion bar 148. This engagement limits the deflection of cross wire spring 110. At this point, all of the load applied to the cross wire spring 110 is transferred to the lower connecting sections 150 thus limiting the deflection of the cross wire spring 110.

The combination of the cross wire springs 110 and the spring modules 106 permits the use of smaller diameter spring wire in the cross wire springs and the spring modules which reduces cost. The smaller diameter spring wire may also be used because of the limited deflection characteristics above described which limit the deflection so that the maximum stress that the springs are subjected to is below the point where the spring modules would take a set and therefore an extended service for the entire box spring assembly is achieved.

The above described arrangement of notched long wires and cross wire springs and notched support deck springs in the embodiments above also eliminates the requirement for using clips to secure the springs to the deck wire grid in a box spring assembly. Fewer parts are required, less material is required, and the step of clip attachment is eliminated in the box spring assembly according to the present invention.

While the above constitutes the preferred embodiments of the present invention, it will be appreciated with the invention to be susceptible to modification, variation and change without departing from the proper scope the fair meaning of the accompanying claims.

What is claimed is:

1. A box spring assembly comprising:

a generally horizontal frame;

a generally horizontal mattress support deck disposed a predetermined distance above said frame, said deck including a border wire and a plurality of long and cross wire members which extend perpendicular to one another, said long wire members extending lengthwise of said frame and said cross wire members extending crosswise of said frame, each of said long and cross wire members being formed of spring wire and having a plurality of spaced notches, said long wire members and said cross wire members engaging each other at intersections; and a plurality of deck support springs arranged between said deck and said frame so as to yieldably support said deck on said frame, each of said springs including vertically yieldable portions mounted at their lower ends on said frame and terminating at their upper ends in a deck attaching portion, at least one of said deck attaching portions including a pair of end straight wire sections arranged in a side-by-side relation with a spaced pair of said long wire members and a connecting portion joining said end straight wire sections and passing over said pair of spaced long wire members, said end straight wire sections being arranged in a supporting relation with a pair of spaced portions of said cross wire member that intersects said spaced pair of said long wire members, each of said end straight wire sections having a notch therein engaged with one of said spaced portions of said cross wire member adjacent said intersection of said long wire members interlocking said long and cross wire members and said end straight wire section together adjacent said intersection.

2. The assembly according to claim 1 wherein at least one of said cross wire members has integrally formed at its ends wire spring sections attached to said border wire and extending downward to said frame and said long wire members are secured at their ends to said border wire.

3. The assembly according to claim 1 wherein two of said notches in said cross wire member intersecting said spaced pair of long wire members are spaced between and adjacent the intersection of said cross wire member and said spaced pair of long wire members, said notches in said cross wire member coacting with said notches in said long wire members and said straight wire sections to interlock said long and cross wire members together.

4. The assembly according to claim 3 wherein said cross wire member passes over said deck attaching portion and under said spaced pair of long wire members at said intersections.

5. The assembly according to claim 4 wherein a portion of said cross wire member crosses under said deck attaching portion between said intersections with said spaced pair of long wire members.

6. The assembly according to claim 5 wherein said deck attaching portions pass over said spaced pair of long wire members.

7. The assembly according to claim 1 wherein said notches in said end straight wire sections are centrally located on said end straight wire sections.

8. A box spring assembly comprising a generally horizontal frame;

a generally horizontal mattress support deck disposed a predetermined distance above said frame, said deck including a border wire and a plurality of substantially straight long and cross wire members intersecting in a criss-cross fashion, said long wire members extending lengthwise of said frame and said cross wire members extending crosswise of said frame, each of said long and cross wire members being formed of spring wire and having a plurality of spaced apart notches, said long and cross wire members being engaged with each other at said notches at the intersection of said long and cross wire members; and a plurality of deck support springs arranged between said deck and said frame so as to yieldably support said deck in said frame, said springs including vertically yieldably portions mounted at their lower ends on said frame and terminating at their upper ends in deck attaching portions, at least one of said deck attaching portions including end straight wire sections arranged in a side-by-side relation with a spaced apart pair of said long wire members, and a connecting portion joining said end straight wire sections and passing over said pair of spaced long wire members, said end straight wire sections being arranged in a supporting relation with a pair of spaced portions of said cross wire members that intersects said spaced apart pair of said long wire members, at least one of said end straight wire sections having a notch therein engaged with one of said spaced portions of said cross wire member adjacent said intersection with said long wire member interlocking said long and cross wire members and said end straight wire section together adjacent said intersection.

9. The assembly according to claim 8 wherein at least one of said cross wire members extending crosswire has integrally formed at its ends wire spring sections attached to said border wire and extending downward to said frame and said long wire members extending lengthwise of said frame are secured at their ends to said border wire.

10. The assembly according to claim 9 wherein said cross wire member passes over said deck attaching portion and under said spaced apart pair of long wire members at said intersections.

11. The assembly according to claim 10 wherein a portion of said cross wire member crosses under said deck attaching portion between said intersections with said spaced apart pair of long wire members.

12. The assembly according to claim 11 wherein said deck attaching portions pass over said spaced apart pair of long wire members.

13. The assembly according to claim 8 wherein said notches in said end straight wire sections are centrally located on said sections.

* * * * *